US010143287B1

(12) United States Patent
Zorn

(10) Patent No.: US 10,143,287 B1
(45) Date of Patent: Dec. 4, 2018

(54) PRINCESS HOME PEDICURE KIT

(71) Applicant: Margaret D Zorn, Nottingham, MD (US)

(72) Inventor: Margaret D Zorn, Nottingham, MD (US)

( * ) Notice: Subject to any disclaimer, the term of this patent is extended or adjusted under 35 U.S.C. 154(b) by 187 days.

(21) Appl. No.: 15/069,767

(22) Filed: Mar. 14, 2016

Related U.S. Application Data

(60) Provisional application No. 62/177,383, filed on Mar. 13, 2015.

(51) Int. Cl.
*A45D 29/18* (2006.01)
*A45D 29/20* (2006.01)

(52) U.S. Cl.
CPC ..... *A45D 29/20* (2013.01); *A45D 29/18* (2013.01); *A45D 2200/25* (2013.01)

(58) Field of Classification Search
CPC ..... A45D 29/18; A45D 29/20; A45D 2200/25
USPC ..... 132/73.5, 75
See application file for complete search history.

(56) References Cited

U.S. PATENT DOCUMENTS

| | | | | |
|---|---|---|---|---|
| 3,085,842 | A * | 4/1963 | Johnson | A45D 29/18 297/423.14 |
| 4,075,457 | A * | 2/1978 | Williams | A45D 29/22 219/218 |
| D426,586 | S * | 6/2000 | Underbrink | D21/483 |
| 6,532,969 | B2 * | 3/2003 | Nuzzo | A45D 29/22 132/286 |
| 6,832,688 | B1 * | 12/2004 | Rivera | A45D 44/04 132/286 |
| 7,900,296 | B2 * | 3/2011 | Lev | A61H 15/0078 4/622 |
| 2005/0235411 | A1 * | 10/2005 | Lev | A47K 3/022 4/622 |

* cited by examiner

*Primary Examiner* — Ryan A Reis

(57) ABSTRACT

The kids portable pedicure spa is light weight and has a flexible handle for easy traveling. The spa can be battery operated or can use the electric cord and plug to power the jets for the bubbles action and to activate the water heating system. The power to the spa is easily controlled by using the on and off switch located on the side of the tub bowl. The spa comes with two removable soft and extendable foot rest pads that adjust for length desired. There are built in storage compartments located on the outer side walls of the tub bowl that can hold nail polish, cotton ball, Q-tips and other nail accessories for convenience. The light weight tub bowl makes for easy use and clean up when filling the bowl with water and disposing of the water when finished using the pedicure spa.

4 Claims, 6 Drawing Sheets

PRINCESS HOME PEDICURE KIT

BACKGROUND OF THE INVENTION

Many kids want to be like their parents and do the same things especially little girls with their moms. Girls watch their mom get dressed up and go to a salon to get their hair and nails done. So many little girls play dress up with their friends and like to have their nails painted as well. I'm sure moms would enjoy having a mother and daughter spa day. However, it is costly for a child's salon pedicure compared to painting their nails at home since their toe nails are so small and require very little nail polish. Another problem parents experience is that adult nail salons are not equipped to service little kids as their legs are short and their feet do not reach the adult salon spa tub. Therefore, most mom's find it relaxing and cheaper to go to the nail salon for a pedicure without the little ones. I have invented the "Princess" portable spa so that little girls everywhere can experience a spa day either with their mom's, family members or friends. The light weight spa tub can be taken to a family member or friends house to experience the fun of a spa day. The "Princess" portable spa can also be used for parties with family and friends with little kids. Mom's will enjoy having a spa day at home with their little girls especially on rainy or cold days when the kids are bored and they are trying to find something to do. To make the spa even more special for the little princess, she can choose a design of her choice for the spa cover and a color for the tub bowl. Being able to choose the design and color makes it more of a personalized spa especially if their friends also have a "Princess" portable spa. This way they can have different ones to make it a fun and happy girl's spa day.

OBJECTS OF THE INVENTION

It is a main object of the present invention to provide a means and a method for little girls to experience a pedicure spa day like her mommy anytime in the convenience of her own home.

It is another object of the present invention to provide a means and a method for the user to be able to experience a fun pedicure spa day at their friend's house and other family member's houses.

It is another object of the present invention to provide a means and a method for a fun and easy clean up portable spa.

It is another object of the present invention to provide a means and a method for the user to carry the spa with them to a kid party and sleep overs to experience a fun pedicure spa day with others.

It is another object of the present invention to provide a means and a method for the little kids who are at home board bored looking for something fun to do on a rainy and/or cold day.

SUMMARY OF THE INVENTION

Kids everywhere can have a fun spa day anywhere and anytime with family and friends when owning a kids princess portable pedicure tub bowl kit. They can enjoy a warm foot message through activating bubbles being generated through air jets and a water warming system. The light weight portable pedicure tub and flexible carrying handle also makes it convenient to carry and have readily available with their nail polish and other nail accessories being kept within the built in compartments that are attached to the side walls of the tub bowl. The foot rest pads are removable, washable and are adjustable which makes it easier for the user to be able to adjust the length to their desire. The foot pads allow the user to relax their feet in comfort while having their toe nails painted and while waiting for them to dry.

DETAILED DESCRIPTION OF THE INVENTION

Figure 1:
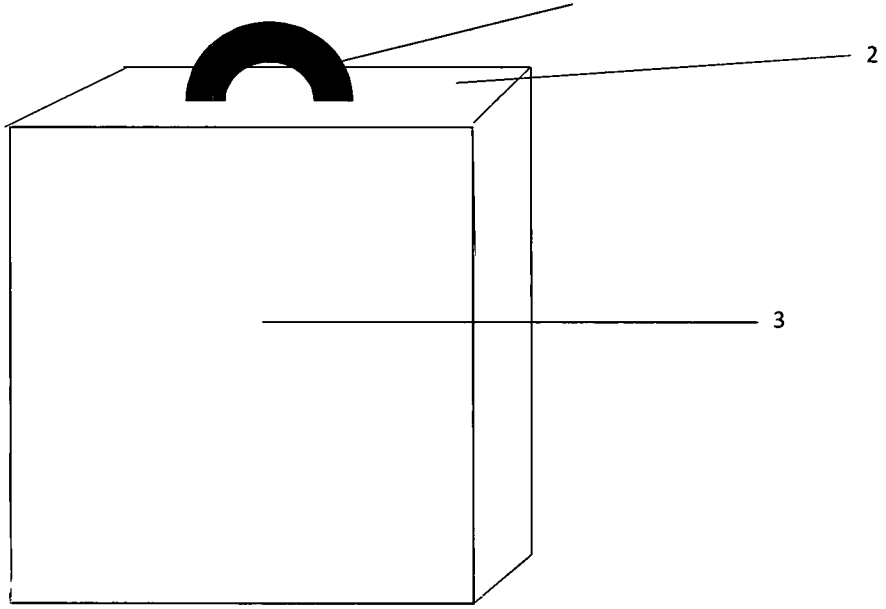
FIG. 1 is a view of the top cover of the portable pedicure tub with the flexible carrying Handle and the front side wall of the tub bowl.
Figure 2A:
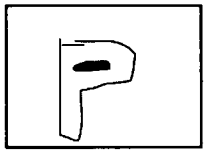
FIGS. 2A-2F are pictures of different designs that can be placed on the removable top cover of the spa.
Figure 2B:
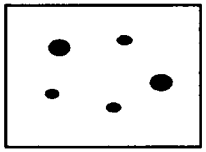
Figure 2C:
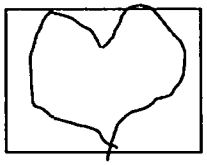
Figure 2D:
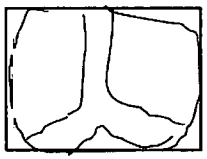
Figure 2E:
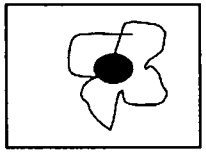
Figure 2F:
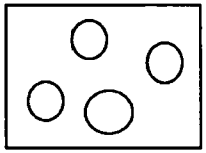
Figure 3:
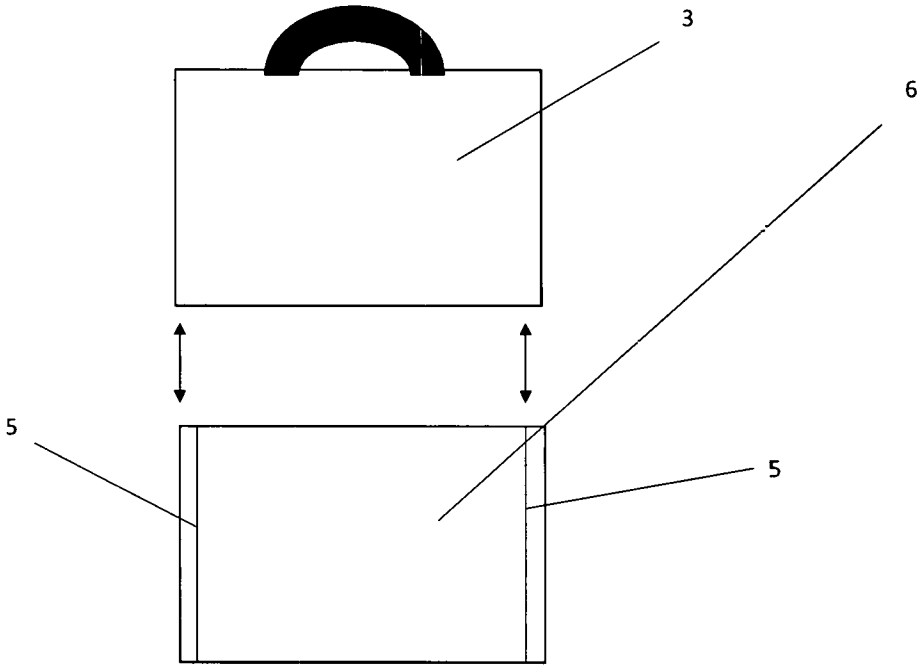
FIG. 3 shows the left and right slot openings located on the top of the tub bowl for Allowing the left and right front corners of the top cover to be inserted so that it connects With the tub bowl to make the pedicure tub portable for traveling.
Figure 4:
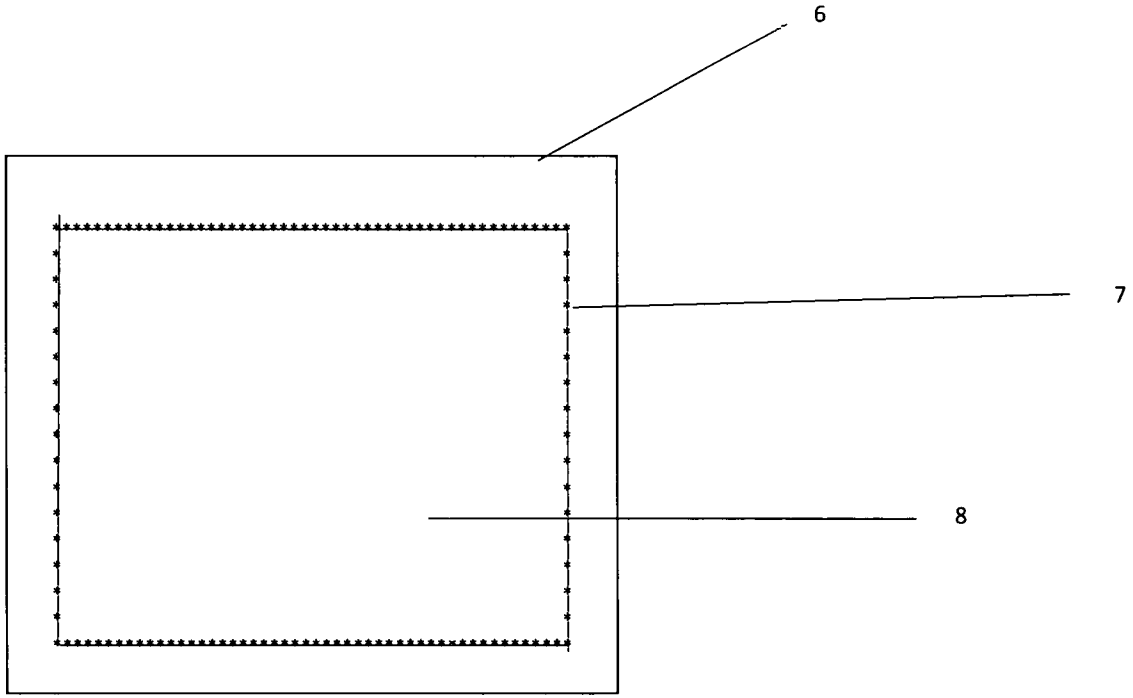
FIG. 4 is viewing where the air jet holes are located along the inner side walls of the tub Bowl towards the bottom near where the foot mat is located.
Figure 5:
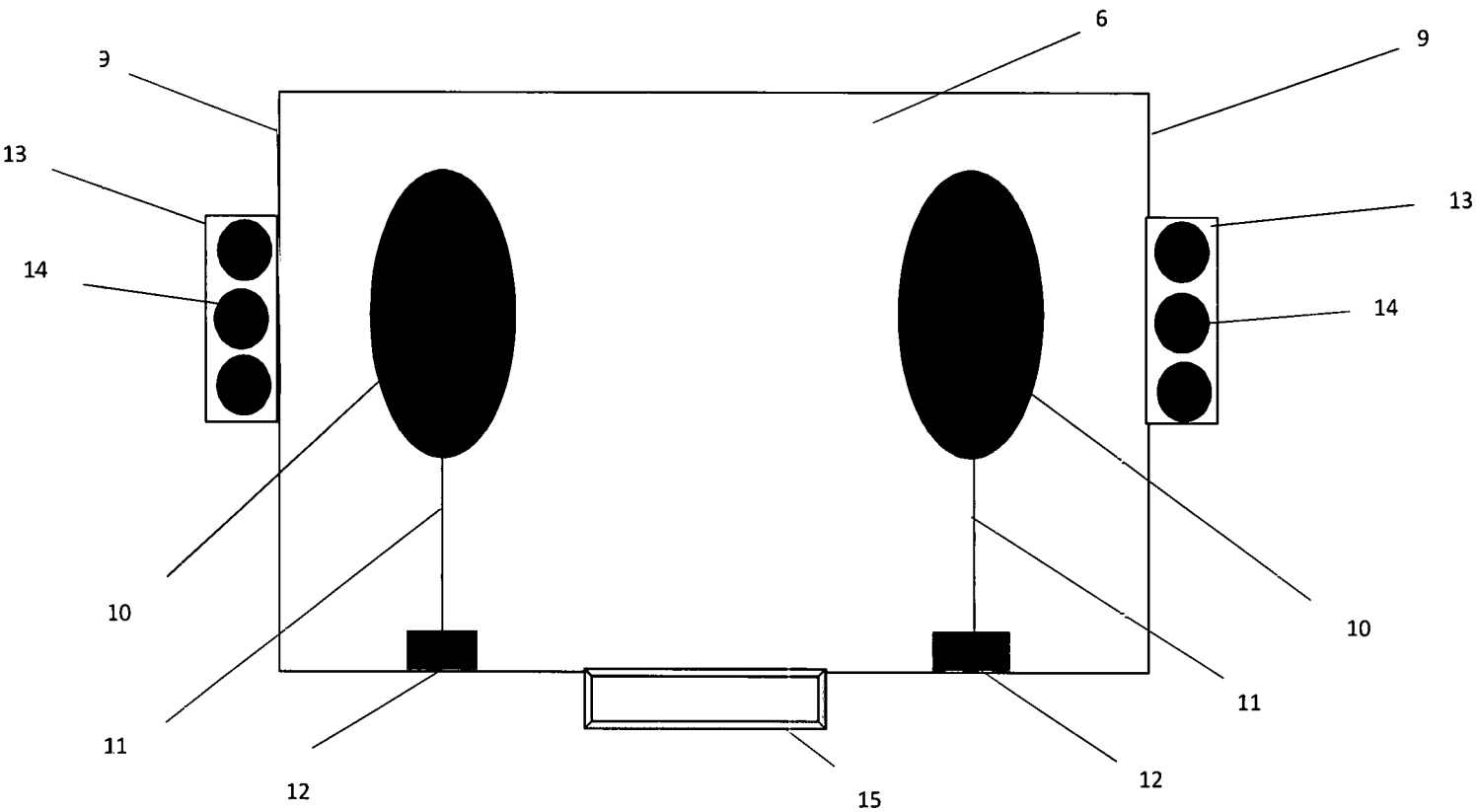
FIG. 5 shows additional items that are attached to the tub bowl's inner and outer walls Such as storage compartments and the extendable foot rest pads.
Figure 6:
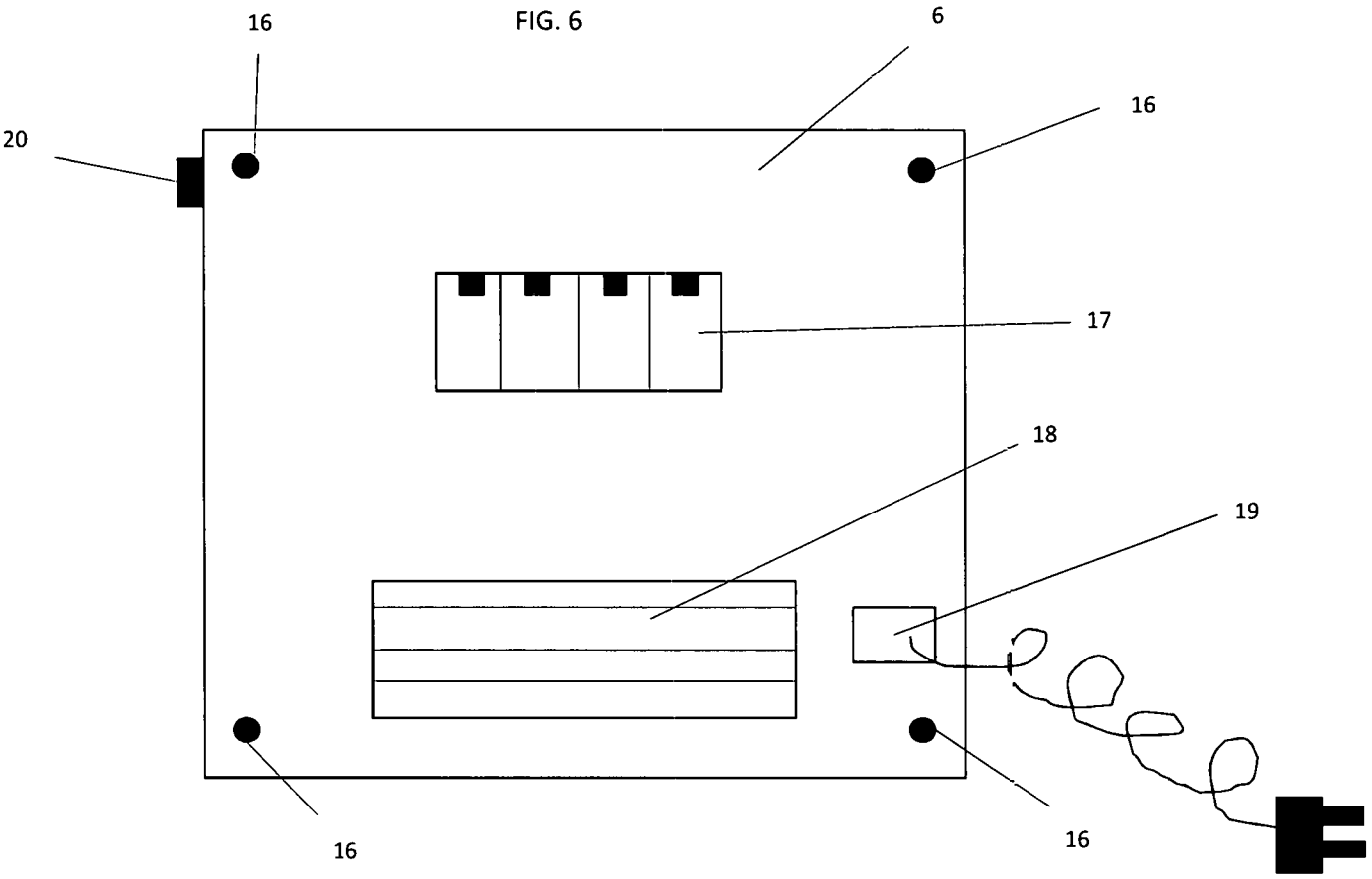
FIG. 6 shows the bottom underneath part of the tub bowl which includes the power on And off switch, the battery compartment, the electric cord and plug compartment, the air Vent and the rubber leg rests for sitting the tub bowl on the floor.

Showing in FIG. 1 is the top cover section of the kids portable pedicure spa made of Plastic material 3. A flexible fold down carrying handle 1 is mounted on the front wall 2. The top cover comes in different designs and colors, examples shown in FIGS. 2A-2F. FIG. 3 shows the left and right sides 5 of the top cover 3 slides into the left and right slot openings 5 on the top of the plastic tub bowl to secure the two sections. FIG. 4 is the tub bowl 6 that holds water and is made with light weight sturdy plastic material for easy portable traveling. The tub bowl 6 is light and easy to pick up for filling with water from a sink and to empty the water when finished into the sink. The tub bowl's 6 inner side walls have air holes 7 to allow air flow to create the bubbles for the spa. The easy removable, replaceable, washable mat is located at the bottom of the tub bowl 6. The foot mat 8 is made of soft, smooth and quick dry material to rest feet on while enjoying the bubble action from the jets. FIG. 5 is showing additional items attached to the side walls 9 of the tub bowl 6. The easy removable foot rest pads 10 are made of soft and sturdy material that is easy to clean with soap and water. An example of the material would be neoprene or similar synthetic polymer. Each removable pad 10 is attached to a flexible pull out retractable, adjustable material 11 that extends and supports the foot rest 10. Material 11 is attached to the front top inside of the tub bowl with a hinge box 12 to hold the expandable retractable material 11. An example of the retractable material is a telescope rod or other similar expandable structures that allow the foot pads to extend out of the hinge box in use and collapse into the hinge box for storage. To expand the foot rest 10, hold onto the foot pads and pull out to a comfortable length for resting feet on. 13 is pull out side drawers located on the left and right outer side walls of the tub bowl. The side drawers 13 contain little compartments 14 used to hold nail polish bottles while painting toe nails to avoid spilling nail polish. 15 is a pull out storage compartment located on the front outer side wall of the tub bowl and is used to hold nail accessories such as cotton balls, Q-tips, nail file, nail clippers and other nail items for easy access. FIG. 6 is viewing the bottom underneath part of the spa tub bowl 6. 14 is a small round rubber leg part used to sit the tub bowl on floor surface. 17 is the battery compartment which holds the batteries that supplies the power needed for the air jets and the water heating system. The battery option can be used when traveling and there is not a plug outlet around. 18 is the fan vent opening for the air jets and heating system. 19 is the electric cord attachment that folds up into a little compartment in the underneath part of the spa tub bowl on the lower right hand side. The electric cord 19 can be used to power the air jets and heating system when there are no batteries available at the time of use of the spa. 20 is the on and off power switch that controls the air jets and the heating system.

The invention claimed is:

1. A portable pedicure spa kit, comprising:

a tub bowl;

a top cover slideable into slot openings in the tub bowl;

a handle attached to the top cover;

air bubble jets located on inner side walls of the tub bowl;

a water heating system connected to the tub bowl;

a plurality of pull out drawers on outer side walls of the tub bowl; and an adjustable foot rest attached to the tub bowl by a hinge box, wherein the foot rest expands out of the hinge box for use and collapses into the hinge box for storage.

2. The portable pedicure spa kit of claim 1 further comprising:

a plurality of tub bowl colors.

3. The portable pedicure spa kit of claim 1 further comprising:

a plurality of designs to be applied to the top cover.

4. The portable pedicure spa kit of claim 1 further comprising:

a removeable foot rest pad.

* * * * *